US010590734B2

(12) United States Patent
Gosselin

(10) Patent No.: US 10,590,734 B2
(45) Date of Patent: Mar. 17, 2020

(54) CASING LANDING AND CEMENTING TOOL AND METHODS OF USE

(71) Applicant: LONGHORN CASING TOOLS, INC., Calgary (CA)

(72) Inventor: Randall Gosselin, High River (CA)

(73) Assignee: LONGHORN CASING TOOLS INC., Calgary (CA)

( * ) Notice: Subject to any disclaimer, the term of this patent is extended or adjusted under 35 U.S.C. 154(b) by 21 days.

(21) Appl. No.: 15/945,616

(22) Filed: Apr. 4, 2018

(65) Prior Publication Data

US 2018/0291704 A1 Oct. 11, 2018

Related U.S. Application Data

(63) Continuation of application No. 14/872,087, filed on Sep. 30, 2015, now abandoned.

(60) Provisional application No. 62/219,818, filed on Sep. 17, 2015, provisional application No. 62/057,770, filed on Sep. 30, 2014.

(51) Int. Cl.
*E21B 33/14* (2006.01)
*E21B 34/06* (2006.01)

(52) U.S. Cl.
CPC ..... *E21B 33/14* (2013.01); *E21B 34/06* (2013.01)

(58) Field of Classification Search
CPC ..... E21B 33/14; E21B 34/08; E21B 33/13
See application file for complete search history.

(56) References Cited

U.S. PATENT DOCUMENTS 6,253,856 B1 * 7/2001 Ingram ..... E21B 34/08 166/374
2006/0118306 A1 * 6/2006 Laplante ..... E21B 21/10 166/319
2009/0242210 A1 * 10/2009 George ..... E21B 34/08 166/373

* cited by examiner

*Primary Examiner* — Giovanna C Wright
*Assistant Examiner* — Brandon M Duck
(74) *Attorney, Agent, or Firm* — Parlee McLaws LLP; C. F. Andrew Lau

(57) ABSTRACT

A casing landing and cementing tool has a wellbore obstruction-clearing tool at a downhole end thereof and a check valve uphole of any fluid vulnerable components to isolate the vulnerable components from the threat of cement incursion. The check valve is manufactured of drillable materials, the plunger being axially actuable but non-rotatable, the valve body being threadably secured within the tool. In one aspect the tool is a sleeve bit rotatably and reciprocally coupled about a mandrel secured to a non-rotating casing string, the check valve located in the mandrel. In another aspect, the tool is a bit coupled to a rotatable casing string, the check valve located in the bit.

7 Claims, 14 Drawing Sheets

CLOSED POSITION

OPEN POSITION

CASING LANDING AND CEMENTING TOOL AND METHODS OF USE

FIELD

Embodiments herein related to apparatus and methods for successfully re-entering wellbores in particular to engaging and facilitating the movement past of sharp obstructions or deviations in the wellbores including washouts.

BACKGROUND

In the oil and gas industry, following drilling of a well, or portion of a well, there is a need to re-enter the drilled openhole portion of the wellbore, for the installation of casing or cementing strings. Local deviations in the raw drilled formation of the wellbore can impede such re-entry, such deviations including wellbore eccentricity, washout and debris. In rotating strings the risk imposed by such deviations in minimal, however, at the end of a long string, in particular at high build sections or horizontal well portions, the conveyance string is not rotatable, or rotation is discouraged. In such cases, there is a high risk that the string cannot progress past the obstruction or deviation.

While casing strings have been rotated to assist with moving past or through an obstruction, high torque created by trying to rotate a long string of casing may result in significant damage to the threads between casing joints and may cause centralizers and the like to drag and ream into the wellbore. While rotation of casing may be a viable option in a vertical wellbore, albeit fraught with problems, it is extremely difficult, if not impossible in a horizontal wellbore.

Thus, the normal means for overcoming such impediments, such as rotation of the entirely of the string for rotation of the distal end, bit or other leading edge, are not available. A downhole tool inserted into the lateral borehole could engage a discontinuity and, in long non-rotating strings, could be difficult to overcome and be unable to run in any deeper and operations frustrated.

Further, In the oil and gas industry, following drilling of a wellbore into a formation for the production of oil or gas therethrough, the wellbore is typically cased and cemented to line the annular length of the wellbore for ensuring safe control of production of fluids therethrough, to prevent water from entering the wellbore and to keep the formation from "sloughing" or "bridging" into the wellbore. Cementing procedures often employ a cementing tool such as a float shoe or a float collar disposed along a casing string for conducting cement into the wellbore and back up along the annulus between the casing and the drilled wellbore.

The cementing tool typically has a mechanism that prevents reverse flow of wellbore fluids into the casing while the casing is run in and also prevents reverse flow of cement slurry from the annulus into the casing after cement is injected. In some cases, this mechanism can be in the form of an internal check valve, and in some other cases, this mechanism can be in the form of an actuable sleeve that opens and/or closes ports on the cementing tool.

For example, U.S. Pat. No. 7,617,879 to Anderson teaches a casing shoe that attaches to a downhole end of a casing string. Anderson's casing shoe has an internal check valve that is biased by a spring to remain closed during running in of the casing string. The check valve is then opened by a pressure created by a cement slurry being injected downhole. The casing string is not equipped to overcome obstructions and may not land at the desired target depth.

It is well known that during the running in of the casing in horizontal wellbores as well as in vertical wellbores, particularly production casing, the casing string may encounter obstructions in the wellbore, such as that created by sloughing of the wellbore wall into the open hole or as a result of the casing pushing debris ahead of the bottom end of the casing along the open hole until it forms a bridge. Such obstructions prevent the advance of the casing and require the open hole to be cleared in order to advance the casing to the bottom of the hole.

Typically this requires running a separate drilling string downhole to attempt to clear the obstruction then trying once again with the cementing string. Thus in alternative approach, others have contemplated providing obstruction-engaging teeth, such as a drill bit, on the bottom of the casing string or on a shoe at the bottom of the casing string to assist with cutting away the obstruction as the casing is advanced during running in.

As known in the industry, cementing tools are not equipped with the ability to drill or otherwise be used to remove such obstructions. Accordingly, should the casing string becoming sufficiently engaged in a mud pack formed at the obstruction, differential sticking may occur making or removal of the casing from the wellbore extremely difficult and certainly advancing improbable.

U.S. Pat. No. 7,757,764 to Vert et al. discloses a float collar disposed along a casing string and having a drilling assembly running therethrough. Upon completion of drilling operations, the drilling assembly is removed from the wellbore, such as through the casing string, and a cement float can be placed downhole to engage the float collar, after which cement slurry can be pumped in. In order to manage both drilling and cementing separate runs are required to change strings.

Also, while it is known casing strings may be rotated to assist with moving past or through an obstruction, high torque created by trying to rotate a long string of casing may result in significant damage to the threads between casing joints and may cause centralizers and the like to drag and ream into the wellbore. Typically, when an obstruction is encountered, drilling fluids are pumped through the casing while the casing is being reciprocated. The fluids act on the debris in the wellbore in an attempt to wash out the debris and lift it up the annulus to surface. Should the washing technique be unsuccessful, it is known to trip out the casing and run in a mud motor on a drill string to clear the obstruction from the wellbore. Such repeated running in and tripping out is time consuming, labor intensive and, as a result, very expensive. Thus, there have been tools applied at the distal end of the casing that enable clearing of obstructions without casing rotation.

For example, U.S. Pat. No. 8,191,655 to Declute-Melancon teaches a tool that can be axially reciprocated by the casing string to actuated a drill bit attached thereto for drilling out obstructions. In cases where a wellbore obstruction is encountered during cementing operations, the cementing operations would have to be delayed to allow the tool to be run in to clear the obstruction. Once the obstruction is cleared, the casing string would have to be tripped out and the cementing operations restarted.

Similarly, as shown in FIG. 1A and as set forth in Applicant's issued U.S. Pat. No. 8,973,682 issued on Mar. 10, 2015, a tool is disclosed for clearing out wellbore obstructions using axial reciprocation of the casing string. The tool is limited to clearing, but is not able to aid with cementing.

An aspect about cementing operations is that one cannot afford the expense of accidental incursion of cement back into the casing string, the bore of the casing string being reserved for production and other tools related to fracturing and production. Once again, if cement were to backflow into the casing, a separate expensive drilling run would be required to remove the wayward cement. Both the Declute-Melancon and Applicant's obstruction-clearing tools are vulnerable to cement leakage from the annulus, through the tool rotation mechanisms and back into the casing.

The conventional methodology and apparatus is unable to deal with problems such as both clearing obstruction during run in and competently enabling cementing operations. Ideally, what is required is a relatively simple and inexpensive apparatus that can be incorporated into the casing string during a cementing run for both clearing wellbore obstructions without the need for rotating the casing string. Ideally, the apparatus could be left downhole, after the casing and cementing operations are complete, and later be drilled out, without a significant increase in operational costs.

SUMMARY

A wellbore obstruction-clearing, landing and cementing tool is fit to a downhole end of a string of tubulars, such as a casing string or a string of coiled tubing (CT). In one embodiment, the tool is ideal to ensure that casing can be successfully run in through a portion of open hole to depth, and then cemented therein. Adapted for cementing operations, the check valve portion of a float shoe is situated above the tool drive mechanism to isolate the vulnerable components from the threat of cement incursion. The check valve, while of a more competent manufacture than the cement bodies of conventional floats, is designed for removal by subsequent drilling out such as for wellbore extension purposes.

As introduced above, horizontal or laterals for horizontal wellbores, the ability to rotate casing is limited or precluded. In particular, the transition or build section of the wellbore, from the vertical to horizontal portions are troublesome and can result in one or more difficult deviations for future re-entry including washouts, ledges and cave-ins. After one or more vertical or surface casing sections have been placed, a drill string is used to first traverse the surface casing and then drill the build section. Once the build section is drilled, a string of casing and the tool are run in to place a curved section of casing in the build section for subsequent cementing before the next, substantially horizontal section is drilled for installation of liner and the like.

The tool comprises a tubular mandrel connected at a distal, downhole end of the casing string. The tool is in fluid communication with the bore of the casing string for conduction of fluids from the tool, such as those to aid in run in, including debris removal and displacement, and discharge of cement. The mandrel is fit with a rotatable tubular sleeve concentrically fit thereabout. The downhole end of the sleeve can be fit with an eccentric tip. The uphole end is a circular opening and connector to the cylindrical sleeve. A helical drive is positioned between the mandrel and the sleeve, permitting the sleeve to reciprocate axially along the mandrel and to rotate relative thereto. The helical drive arrangement, a form of which is disclosed in Applicant's issued U.S. Pat. No. 8,973,682 issued on Mar. 10, 2015, the entirely of which is incorporated herein by reference, is formed between the mandrel and the sleeve.

The rotatable sleeve is adapted at a downhole end to present an eccentric bit or spade. The eccentric bit forms a ramp which, when oriented appropriately, to align a ramp face against a deviation, causes the tool and the distal end of the string to climb up any obstruction and enable passage thereby. Appropriate orientation of the bit ramp face is achieved effortlessly as downhole axial movement of the casing string against the obstruction drives the sleeve to rotate, automatically orienting the tool and, once the ramp face reaches the orientation capable of further axial movement, the stool and string continue to advance.

In stubborn cases of obstructions, and when possible, the casing can also be rotated to ream the wellbore using the bit end. The drive can be oriented to be inoperative during right-hand casing rotation to avoid high loading on the drive mechanism. In anticipation of such operational difficulties, the bit can be equipped also with cutters. Upon an axial uphole movement of the casing and mandrel, a spring urges the sleeve away from the mandrel and the sleeve both rotates on the helical drive of the mandrel and extends axially, resetting the tool for another cycle of retraction and extension.

In another aspect, a wellbore obstruction-clearing and cementing tool is fit to a downhole end of a string of tubulars, such as a casing string, intended for rotation. An obstruction clearing bit is located as the distal end of the tool for engaging obstructions and is ideal to ensure that casing can be successfully run in through a portion of open hole to depth, and then cemented therein. Adapted for cementing operations, a check valve is integrated into the bit to act as a float shoe. The check valve, while of a more competent manufacture than the cement bodies of conventional floats, is designed for removal by subsequent drilling out such as for wellbore extension purposes.

DESCRIPTION OF THE EMBODIMENTS

Non-Rotating Casing String

As described below, and with reference to FIGS. 1 to 5, a rotatable obstruction clearing and landing tool is located at the downhole of a casing string. During normal running into the wellbore the casing string need not be rotated to clear obstructions and ensure landing of the casing at target depth. An annulus is formed between the wellbore and the casing. The rotatable tool self-aligns to any obstructions and thereby enables passage thereby. The casing string has a casing bore and the tool has a tool bore in fluid communication with the casing bore. The tool further incorporates a cementing check valve within the tool bore and located uphole of any vulnerable interfaces or components of the tool that can act as a fluid communication path between the wellbore and the tool bore so as to avoid an intrusion of cement back from the annulus and into the tool and casing string. The float collar and tool are drillable for subsequent extension of the wellbore.

Further, and with reference to FIGS. 6 through 15B, a fixed obstruction clearing and landing tool is located at the downhole of a casing string. During normal running into the wellbore the casing string can be rotated including to clear obstructions. The tool comprises a bit that incorporates a cementing check valve therein above fluid ports in the bit in fluid communication between the wellbore and the bit bore. The bit is secure to the distal end of the casing string and does not present any interfaces or components vulnerable to intrusion of cement other than the downhole fluid ports. The float collar and tool are drillable for subsequent extension of the wellbore.

Figure 1:
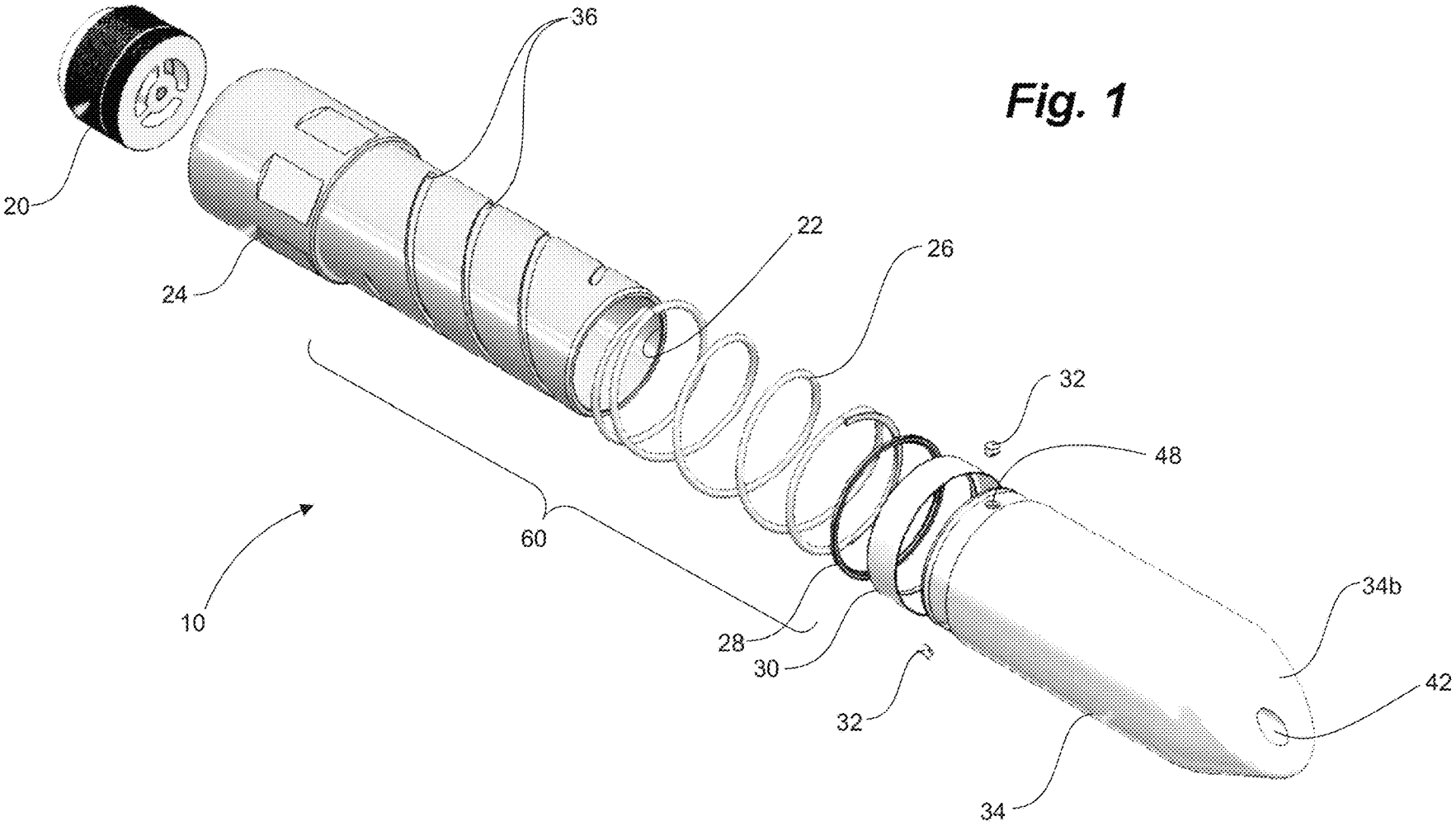
FIG. 1 is exploded perspective view of the tool having, viewed from an uphole end, a two-part cement check valve for installation in the bore of a tool mandrel, the mandrel, a sleeve extension spring, a thrust bushing, a pin retainer sleeve, the bit and a sleeve body in combination.

Turning to the first embodiment of FIGS. 1 to 5, and as shown in exploded perspective view in FIG. 1, a casing landing tool 10 comprises, from an uphole end, a two-part cement check valve 20 for installation in the bore 22 of a mandrel 24, the mandrel 24, a sleeve extension spring 26, a thrust bushing 28, a pin retainer sleeve 30, pins 32, a sleeve 34 and bit 34*b* combination.

Figure 2A:
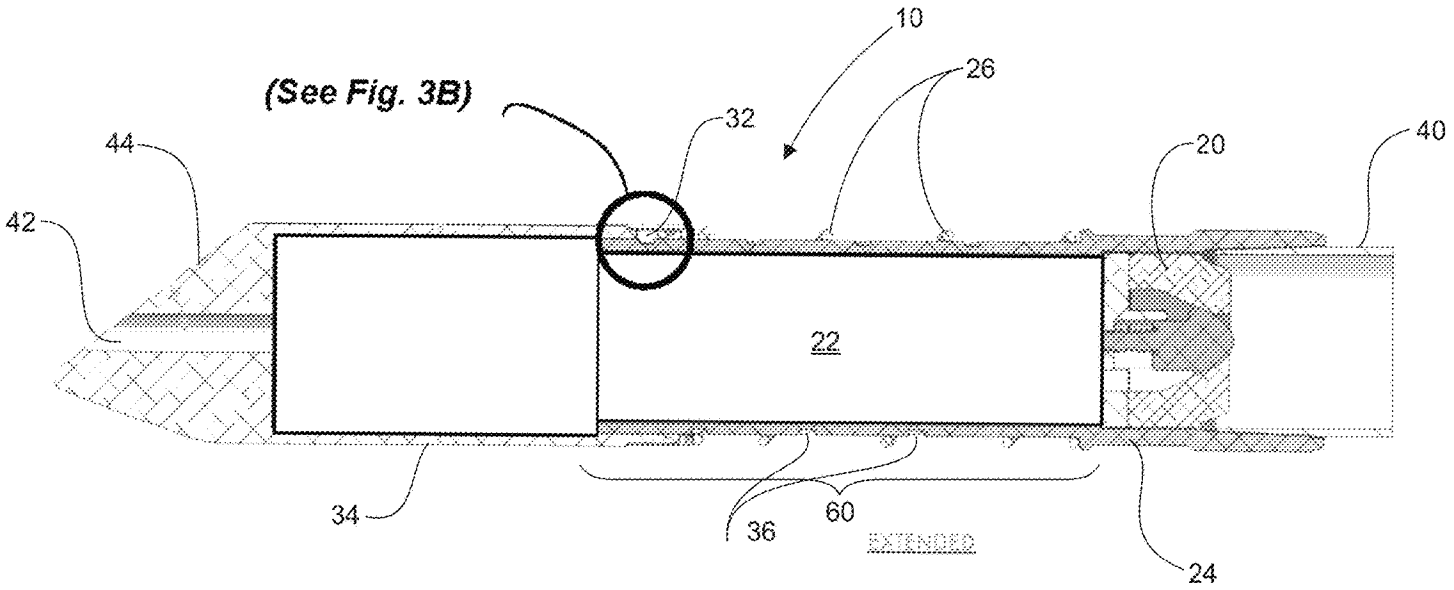
FIG. 2A is a cross-section of the assembled tool of FIG. 1 connected to a downhole, distal end of a sting of casing and with the bit sleeve in the extended state. The check valve is shown installed and closed.

As shown in FIG. 2A, the landing tool is shown connected to a downhole, distal end of a string of casing 40 and with the sleeve 34 in the rotated, extended state. The check valve 20 is shown installed to the mandrel 24 and closed. The mandrel 24 is a tubular and manufactured with one or more parallel helical grooves 36 on the exterior. The sleeve 34 is tubular and movably fit to the outer diameter of the mandrel 24. The sleeve 34 is fit with one or more drive pins 32, corresponding one per groove 36. The mandrel 24 is made of steel and the bit 34*b* formed of a drillable aluminum or aluminum composite.

Figure 2B:
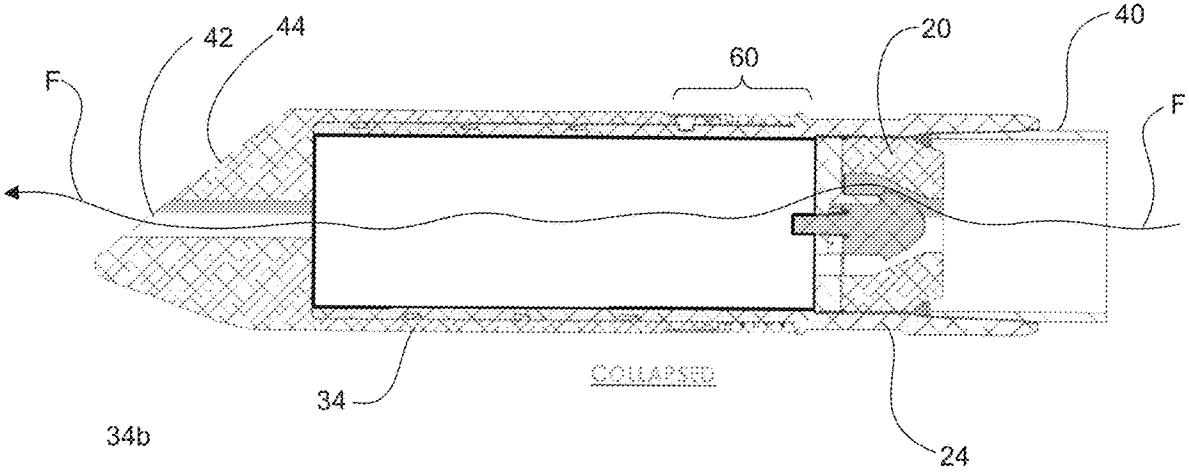
FIG. 2B is a cross-section of the assembled tool of FIG. 1 in shown in the retracted state and the check valve in the open state.

As shown in FIG. 2B, the sleeve 34 is shown in the retracted state. Axial force on the sleeve 34 drives the sleeve rotatably, through the pin 32 and groove 36 interface, and axially onto the mandrel 24. Release of the force permits the sleeve 34 to return to extended state, rotating in the opposing direction.

Figure 2C:
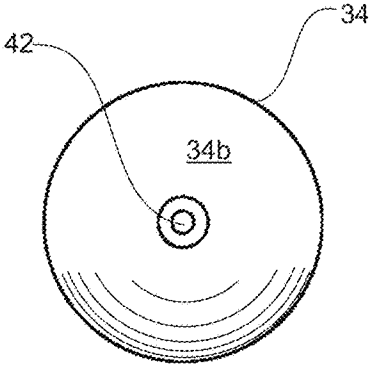
FIG. 2C is an end view of the bit with view a of the bit's fluid discharge port.
Figure 3A:
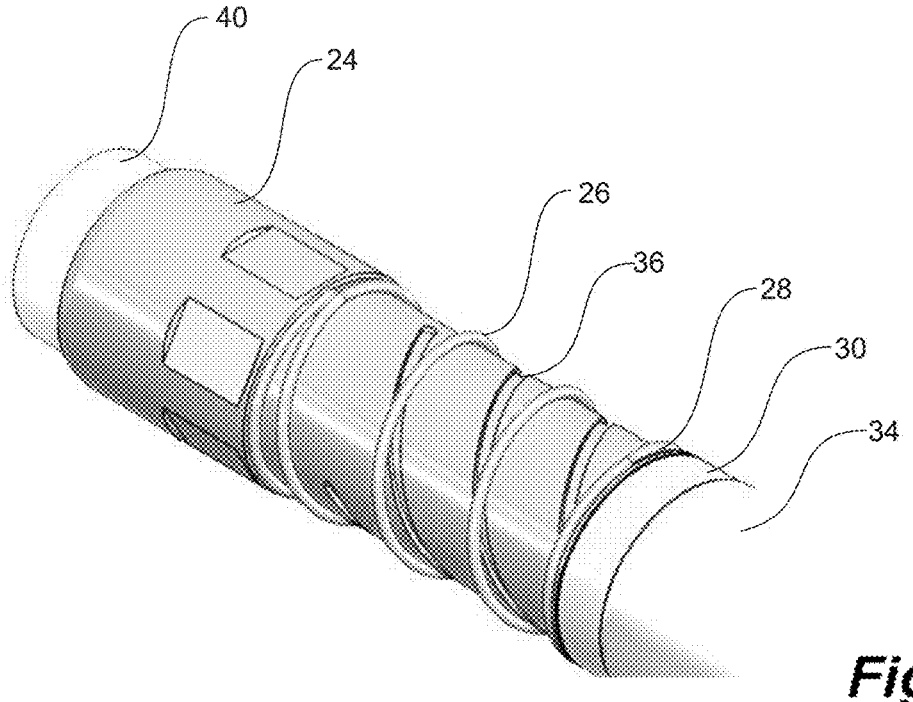
FIG. 3A is a view of the sleeve-extension spring installed to the mandrel.

Extension of the sleeve 34 can be through biasing, as shown best in FIGS. 2A and 3A, or fluid back pressure acting on the sleeve 34 as fluid exits the bit 34*b*, or a combination thereof. For illustration purposes, the check valve 20 is shown in the open state as it would be during flow of fluid F and discharge through an end port 42 in the bit 34*b* as illustrated in FIG. 2C, the fluids F typically being drilling fluids during run in or cement once at depth.

In more detail, and with reference to FIGS. 1-3A, the helical drive comprises the one or more helical grooves 36 on one of the mandrel 24 or sleeve 34 and corresponding one or more drive pins 32 extending radially from the other of the sleeve 34 or mandrel 24 to guide and rotate the sleeve relative to the mandrel as it extends and retracts thereon. Axial reciprocation of the casing string 40 and connected mandrel 24, commonly referred to as stroking of the tubulars within the wellbore, on a downstroke results in driving the rotatable sleeve 34 to retract axially and to rotate relative to the mandrel 24. On an upstroke, the sleeve 34 extends, and rotates, through the impetus of a spring bias or fluid force action.

In the shown embodiment of FIGS. 2A, 2B and 3A, spring 26 is fit axially between the sleeve 34 and the mandrel 24. The spring 26 can be a coiled spring, stopped or supported axially at an uphole end of the mandrel 24, fit concentrically thereabout, and supported axially at an uphole end 49 of the sleeve. Herein, and as the majority of the energy imparted to the tool 10 is string-weight down upon the sleeve during run in, the helix is run clockwise on the mandrel as one looks downhole. Thus, as the casing string is set down, and the sleeve resists moving and is driven uphole (relative to the downhole movement of the casing string) and rotates counter-clockwise onto the mandrel, the reactive vector is to tighten the mandrel on the uphole casing string. Further, if casing rotation is desired, such as early in the run in, to clear significant obstructions, the helical drive-driven sleeve is not attempting to extend against the weight-on-bit. Also, the resetting action of the spring on the sleeve to extend and rotate same is isolated to the tool and has no effect on the threaded connection.

The rotatable sleeve 34 is adapted at a downhole end to present an eccentric bit 34*b* or spade. The eccentric bit forms a ramp face 44 which, when oriented appropriately, aligns the ramp face 44 against a deviation or obstruction. The ramp face 44 firstly causes the sleeve 34 to rotate to align the bit 34*b*. Once aligned, the tool 10 and the distal end of the casing string can climb up and over any obstruction for enabling passage of the tool 10 thereby. Appropriate orientation is achieved effortlessly as downhole movement of the casing string 40 drives the sleeve 34 to rotate, automatically orienting the tool 10 and, once the ramp face 44 reaches the orientation capable of further axial movement, the tool 10 and casing string 40 continue to advance downhole.

Further, once the obstruction is overcome, the return mechanism, shown here as an external spring 26, or in other embodiments, or in combination, fluid hydraulics from delivered fluids through the end port 42 re-extend the sleeve 34 in preparation for the next obstruction, washout or other downhole anomaly.

The eccentric bit 34*b* engages or otherwise contacts any obstructions. At least the rotation of the sleeve 34 orients the ramp 44 of the eccentric with the obstruction. Optionally fluids circulated downhole through the string and uphole to surface in an annulus between the casing string 40 and the wellbore can aid in lessening the obstruction, including accumulations of debris and cave-ins. In such instances, other bits can be used, even those that do not have a specialized eccentric.

The fluids can also aid in hydraulically extending the sleeve 34 during the upstroke and fluidly eroding wellbore obstructions.

With reference to FIG. 3A, the coiled extension spring 26 is installed about the mandrel 24 and sandwiched axially between the mandrel 24 and the sleeve 34. A suitable spring 26 for downhole use would be an 8 inch diameter coil of 0.394 inch diameter wire for a 15 inch long (free length). The spring can have a spring rate of 24 lbf/inch having a compressed force in the order of about 300 lbs.

Figure 3B:
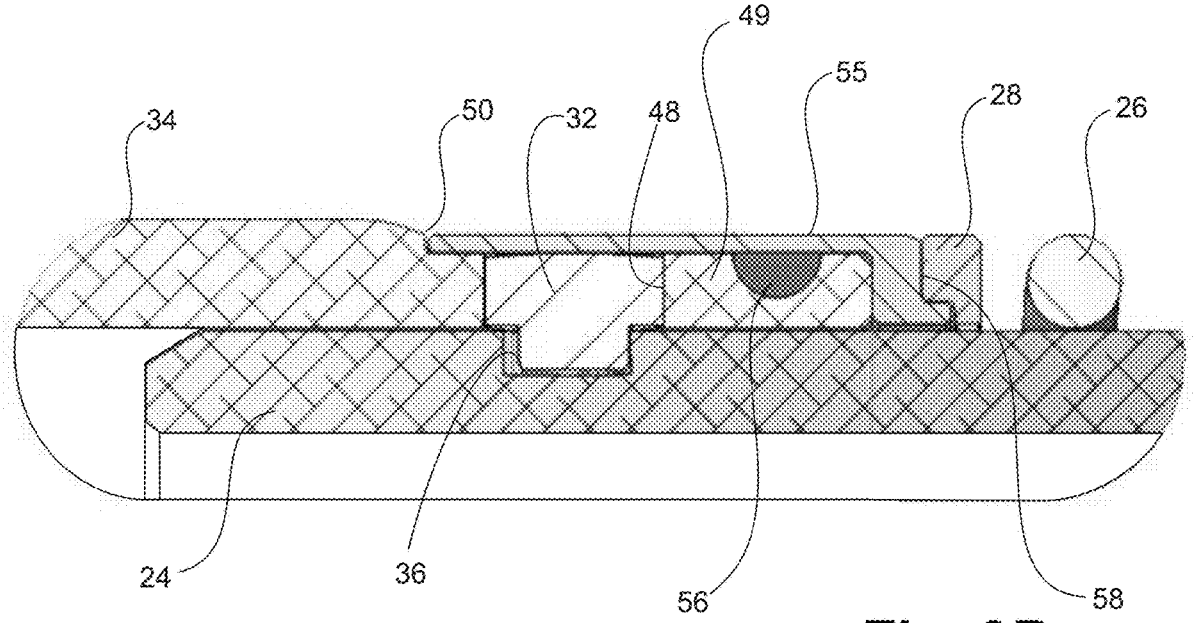
FIG. 3B is a detail of the interface of the sleeve and mandrel interface as extracted and enlarged from the FIG. 2A, the interface illustrating an annular retaining sleeve for retaining helical drive pins within pin ports in the sleeve and engaged with the grooves in the mandrel.

As shown in FIG. 3B, and for convenience of assembly, the sleeve 34, drive pins 32 and grooved mandrel 24 are driveably connected through an assembly interface. The assembly interface of the sleeve and mandrel is shown as extracted and enlarged from FIG. 2A. The assembly interface comprises pin ports 48 formed through the sleeve 34, at an uphole end 49 thereof for radially receiving helical drive pins 32 within for radially engaging their respective grooves 36 in the mandrel 24. The uphole end 49 of the sleeve has an upset 50 so that the uphole end is stepped radially inward to have a slightly smaller diameter than that of the balance of the sleeve 34. The pin ports 48 are formed through the uphole end 49 of the sleeve 34. Once engaged, the drive pins 32 are retained therein by an annular retainer 55 that can be slid over the uphole end 49 of the sleeve and over the pins, retaining the pins 32 radially therein. The annular retainer 55 can be secured to the sleeve, such as by local deformation/dimpling of the annular retainer material into a corresponding dimple recess 56 in the sleeve.

The annular retainer 55 forms an uphole shoulder 58 forming a stop for the spring 26. To minimize wear, a thrust ring or bushing 28, such as a bronze bushing, can be fit between the spring 26 and the shoulder 58 of the annular retainer 55. The thrust bushing 28 bears against the spring 26 on one axial face and the annular retainer 55 on the other.

Check Valve

In this embodiment, the presence of an interface 60 between the moving sleeve 34 and the mandrel 24 introduces an operational vulnerability during cementing operations including the potential for incursion of cement into the tool 10 and casing string from the wellbore annulus. Thus the use of a check valve 20 at the distal end of the tool 10, at the downhole end of the sleeve 34, would introduce some risk. Accordingly, the check valve 20 is fit to the mandrel 24 above the interface 60. In this embodiment, the mandrel 24 is a contiguous tubular and the check valve 20 can be located anywhere along the bore 22 of the mandrel 24. For convenience and access purposes, the check valve 20 is located at an uphole end of the mandrel.

Returning to FIG. 1, the check valve 20 is removably installable to the tool, either to eliminate the check valve from the tool in non-cementing operations, or for ease and security of installation to the mandrel 24. Prior art check valves often include a cement body for ease of removal by drilling, breakdown of the cement often leading to loss of the shoe integrity. Herein, a metal check valve 20 is threadable installed to the mandrel bore 22 for assurance the float remains in place until purposefully removed.

Figure 4A:
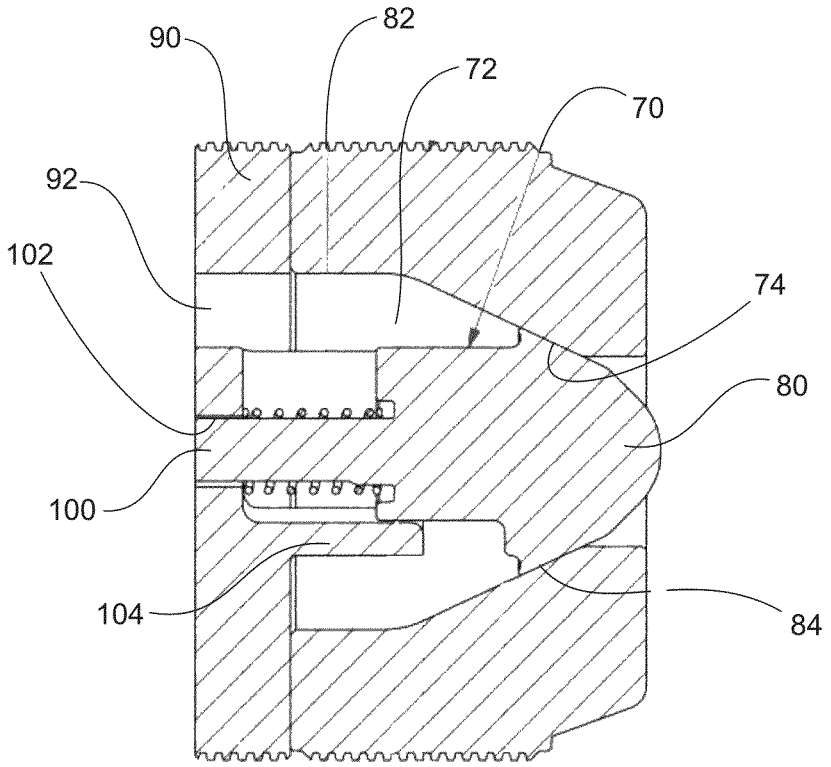
FIGS. 4A and 4B are cross-sectional views of a check valve shown in the biased closed and fluid-opened states respectively.
Figure 4B:
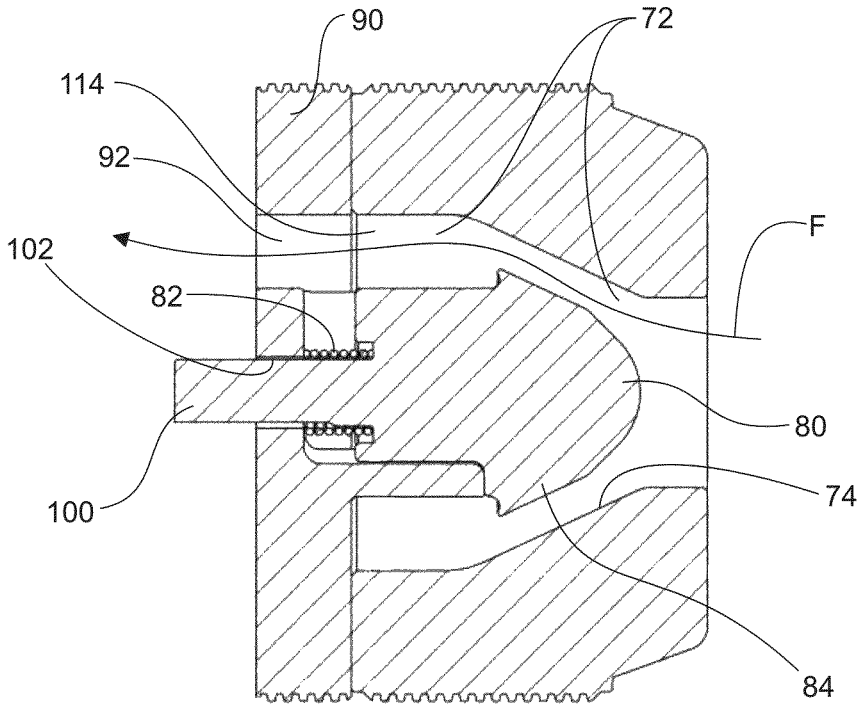
Figure 5:
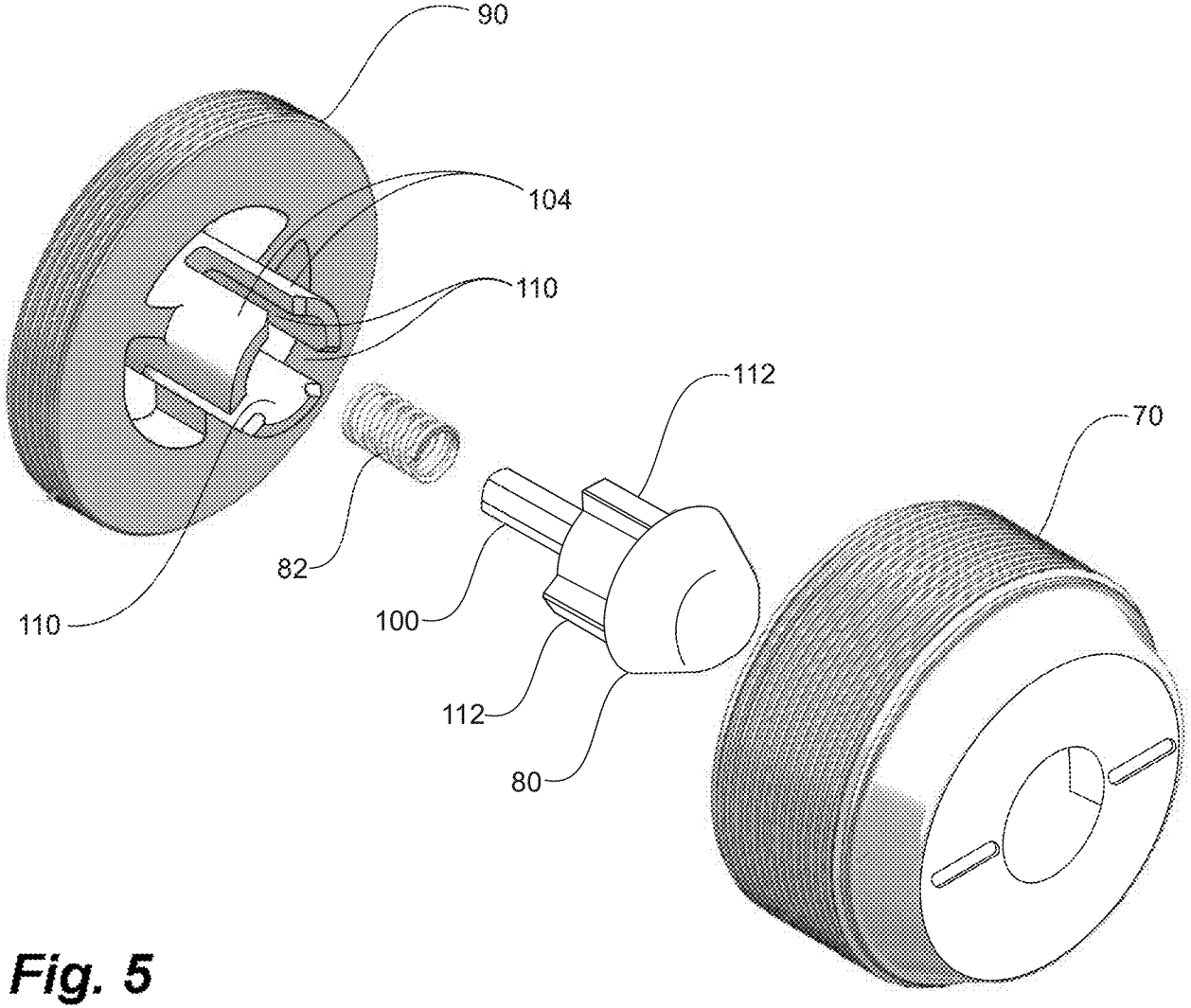
FIG. 5 is a perspective exploded view of the check valve of FIGS. 4A and 4B.

As shown as installed in FIGS. 2A, 2B and in detail in FIGS. 4A, 4B and 5, for cementing of the conveyed casing string, the tool 10 is fit conveniently with the check valve 20, fit to the mandrel and forming a one way fluid valve for enabling fluids F to pass downhole therethrough, but not back up into the casing string 40. The check valve 20 comprises an uphole seat body 70 having a seal bore 72 and a valve seal face 74. The seat body 70 and seal bore 72 house a plunger 80. The plunger 80 is retained axially within the seat body 70 by a downhole retainer body 90. The retainer body 90 also has a retainer bore 92 contiguous with the seat bore 72 for completing a throughbore 114 through check valve 20. The retainer body 90 cooperates with the seat body 70 to form a surrounding housing for the plunger 80. The retainer body 90 and seat body 70 are threadably engaged through the mandrel bore 22 at the uphole end thereof. The plunger 80 and a return spring 82 are fit between the retainer body 90 and seat body 70, either in sequence into the mandrel 24 or before installation. The seat body 70 is threadably engaged to stop against the retainer body 90 for forming the valve. The check valve could be pre-assembled before threaded insertion into the threaded bore of the mandrel 24.

In more detail, as shown in FIGS. 4A, 4B, 5 and 9, the optional spring 82 normally biases and maintains the plunger 80 in a closed position. The spring 82 ensures that possibility of back flow of fluid F, such as cement, is arrested before entering bore of the casing string. The plunger 80 has a conical or mushroom head-shaped head having a circumferential seal face 84, sealably mated with a valve seat 74 formed in the seat body 70 in the closed position. The head of the plunger 80 can also be hot-dipped into a thermal polymer for forming a thin sealing layer 86 about the seal face (FIG. 10B). The plunger 80 is axially movable and guided by stem or shaft 100 extending downhole of the plunger 80. The cylindrical shaft 100 is axially movable through an axial cylindrical guide bore 102 supported by the retainer body 90. The cylindrical guide bore 102 can be supported in a boss 104 portion of the retainer body 90.

Figure 9:
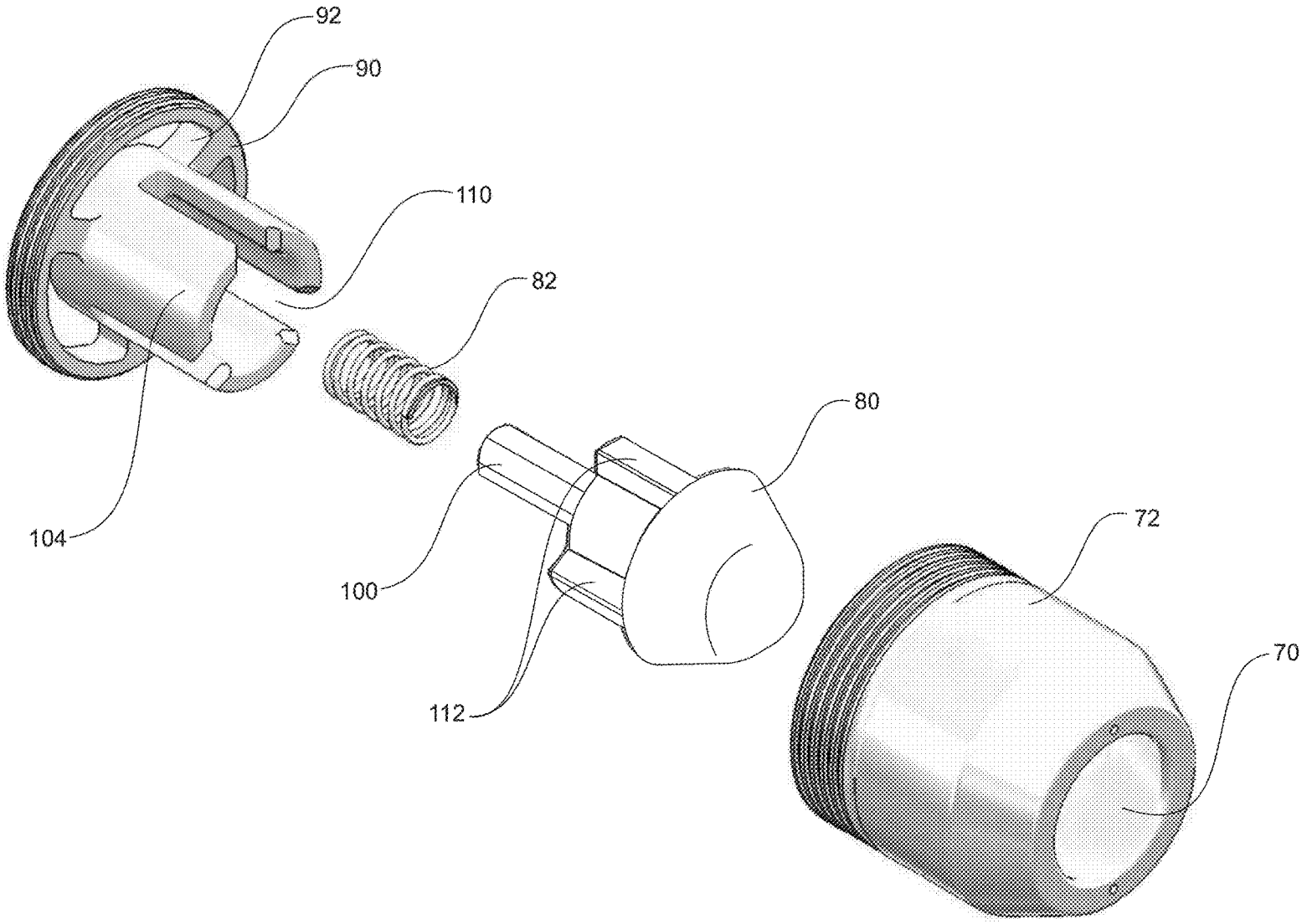
FIG. 9 is an exploded perspective view of the major components of the integrated check valve assembly of FIG. 7.
Figure 12:
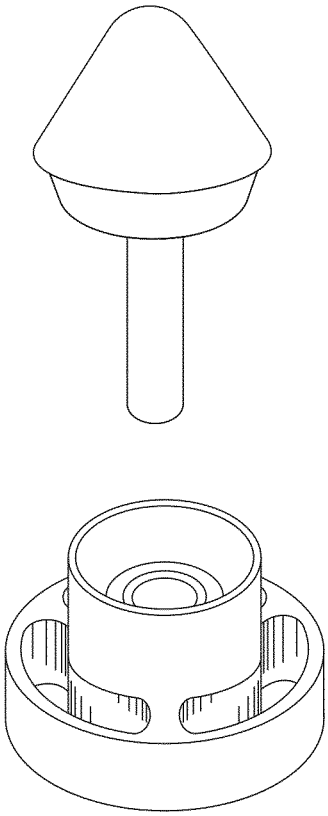
FIG. 12 is an exploded and side perspective view of a plunger and a base body, shaft support portion for an alternate embodiment of a check valve.

As shown in FIG. 12, the plunger 80 can be freely rotating, sometimes useful in maintaining equal wear about the seal interface between the face 84 and the seat 74 or, as shown in FIGS. 5 and 9, corresponding axial guide slots and radial ribs, formed in the boss 56 and on the plunger shaft respectively prevent rotation of the plunger 80. As shown, the boss 104 can be formed with three axially extending slots 110,110,110 (best seen in FIGS. 5 and 9), and corresponding ribs 112,112,112 extend both axially along and radially from the plunger shaft 100. As the plunger 80 is actuated axially, the ribs 112 are guided to slide along their respective slots 110, preventing rotation of the plunger 80.

The plunger 80 can be biased to the closed position by the spring 82. Spring 822 can be a coil spring located concentric about shaft 100 and delimited axially between plunger 80 and retainer body 90.

The body of the check valve 20 is formed in two pieces, in one embodiment, for enabling assembly of the plunger 80 and spring 82 therein.

As shown in FIGS. 4A and 4B, a first downhole body component 90 supports the boss 104 and cylindrical shaft bore 102. A second uphole body component 70 supports the valve seat 74 and forms an uphole valve bore portion 72. The first body component 90 forms a downhole valve bore portion 92. The valve throughbore 114 is formed by contiguous uphole and downhole bore portions 72,92 respectively.

Drillable

In an embodiment implementing the helically driven tool, the internals are drillable to permit cementing and abandonment of the tool, yet permitting a smaller subsequent tool to drill therethrough to deepen or extend the wellbore. Thus the operator need not be concerned, and indeed would plan on leaving the tool downhole and permanently cemented therein. Later, should the wellbore need to be extended, a secondary drill string can be run downhole to drill out the internals of the tool.

This would be the usual case after placement and cementing of casing in the build section of the wellbore. After drilling and casing the build section, a secondary drill string is lowered into the last cemented casing string and tool. The secondary bit encounters the orientation tool. Herein, the mandrel has an inner diameter not that unlike the inner diameter of the string of casing uphole thereof. Therefore, the mandrel and external spring need not be drilled out and need not be manufactured of less competent tool materials. The mandrel inner diameter and therefore its bore, can be maximized to accord with the preceding uphole casing string or liner and thus does not form an impediment to secondary drill strings. The tubular portion of the sleeve is at greater diameter than that of the bore of the mandrel or casing string and need not be drilled out. The distal end of the sleeve, forming the leading component or bit portion however needs to be drilled out to access downhole thereof.

As shown, with an eccentric-tipped sleeve and bit portion can be manufactured as a unitary material. Otherwise, the tubular portion of the sleeve can be of a more competent material, not intended for drilling through, and only the eccentric end would be made drillable. Drillable materials include aluminum, such as 6061-T6 Al, and bronze. The external and end of bit installation of tungsten carbide or PDC components does not adversely affect drillability as the underlying support structure is drill away.

The cemented mandrel remains substantially intact after drilling, the eccentric bit portion having been drilled out. While the entirety of the tool can be made of drillable materials, they are more expensive where equivalent strength is desired, and where compromises are made, less competent overall. Thus, the current tool economizes both the material of components and the extent to which operations are impeded by the drilling through of tool components. Components of the eccentric bit, and optionally the entirely of the sleeve, can be made of drillable materials.

Inherent in its function, springs, such as those manufactured of INCONEL, is resistant to drilling both in its material of construction and its coiled configuration.

Further, rotatable components are resistant to drilling out as they can preferentially rotate ineffectively when contacted by a secondary drill string and avoid being cut. Thus, rotatable components and springs such as the check valve spring and the sleeve biasing spring can be a challenge.

In the case of the sleeve biasing spring, should the drill bit of the drill-through operation engage the spring, the operation can be impeded or even defeated, causing considerable problems with a drilling through of the cemented tool. Hence, location of the coiled spring is strategic in avoiding drill out problems. In an embodiment, the drillable tool includes the extension spring located external to the mandrel and compressible between a top shoulder of the mandrel and a top shoulder of the sleeve so as to energize the spring and bias the sleeve for extension. The spring is located external the mandrel so that it remains separated from the subsequent drill string, thereby avoiding problems and interference with the drill-out operation.

In the case of the check valve spring, as the supporting plunger and depending shaft are drilled out, the small spring is no longer supported and is displaced or falls out the path of the secondary drill string. Further, as described above, the plunger is a non-rotating plunger, supported and thereby drillable by the slot and rib arrangement between the boss and plunger shaft respectively.

In summary, in one aspect, a wellbore obstruction-clearing and landing tool is fit to a downhole end of a tubing string, such as a casing string, for advancing the tubing string through deviations/obstructions in a wellbore. The tubing string has an axial bore therethrough for communicating fluids to an annulus between the tubing string and the wellbore for circulation to surface. The landing tool comprises a tubular mandrel, a tubular sleeve and a helical drive therebetween. The tubular mandrel connects to the downhole end of the tubing string, the mandrel having a mandrel bore extending axially therethrough, and the mandrel bore being fluidly connected to the axial bore. The mandrel is fit with an integrated check valve for fluid flow downhole but not uphole therethrough. The tubular sleeve has a sleeve bore extending axially therethrough and fit concentrically fit about the mandrel, the sleeve bore being fluidly connected with the mandrel bore, and a downhole eccentric ramp end for engaging the wellbore obstructions. The helical drive arrangement, such as the helical drive arrangement set forth in Applicant's issued U.S. Pat. No. 8,973,682, the subject matter of which is incorporated by reference herein, in its entirety, acts between the mandrel and the sleeve for driving the sleeve axially and rotationally along the mandrel between a retracted position and an extended position in response to reciprocating axial movement of the tubing string and mandrel. The engagement of the downhole end of the sleeve with an obstruction rotates the eccentric end until the ramp can slide over the obstruction to enable continued and further running in the wellbore to the desired depth. At depth, any running fluids can be discontinued and cementing operations commenced, cement flowing through the check valve controlled in one direction thereby.

After cementing, the method can further comprise running in of a secondary drill string through the casing string and through the tool's mandrel, engaging the less competent materials of the check valve and eccentric sleeve bit and drilling therethrough for drilling additional open wellbore therebeyond.

The obstruction-clearing tool enables methods for engaging and bypassing obstructions in a wellbore for advancing a tubing string therein without rotation of the tubing string. Such method comprises running a wellbore obstruction-clearing tool on a downhole end of the tubing string, such as casing or CT, the wellbore obstruction-clearing tool having a rotary coupling drive and an eccentric bit fit thereto and acting to orient the eccentric bit to rotate to an bypassing orientation as the wellbore obstruction-clearing tool encounters a wellbore obstruction. In an embodiment the rotary coupling drive comprises a tubular mandrel for connection to the tubing string and tubular sleeve which is axially and rotationally moveable therealong between a retracted position and an extended position. In operation, the method comprises stroking the casing string downhole so as to engage the eccentric with an obstruction for rotation and auto-orientation to ramp up and climb over such obstructions and thereafter to extend again for resetting and actuation at some subsequent obstruction. In additional embodiments, the tool is used for cementing the casing string and tool in the wellbore, utilizing the integrated check valve. Further, the wellbore is extended by drilling out the check valve and eccentric sleeve bit.

In one aspect, a wellbore casing landing or obstruction-overcoming and cementing tool is provided, fit to a downhole end of a casing string for advancing the string through obstructions in a wellbore, the tool fit to a downhole end of a string for engaging and advancing the string past deviations or obstructions encountered in the wellbore, the string having an axial bore therethrough for communicating fluids to an annulus between the casing string and the wellbore for circulation along the annulus, the tool comprising an inner tubular mandrel for connection to the downhole end of the tubing string, the mandrel having a mandrel bore extending axially therethrough, the mandrel bore being fluidly connected to the axial bore, optionally through a check valve; an outer tubular sleeve rotatable about the inner tubular mandrel and extendable therealong having, a sleeve bore extending axially therethrough and fit concentrically fit about the mandrel, the sleeve bore being fluidly connected with the mandrel bore, and a downhole eccentric end for engaging the wellbore obstructions; a helical drive arrangement acting between the mandrel and the outer tubular sleeve for permitting reciprocating downhole and uphole axial movement of the inner tubular mandrel within the outer tubular sleeve to drive the outer tubular rotationally in a first direction about the mandrel towards a retracted position and driving the outer tubular sleeve rotationally in an opposite direction about the inner mandrel towards an extended position respectively; and a coil spring operatively fit about the mandrel and axially between the outer tubular sleeve wherein upon engagement of the downhole end of the tubular sleeve with the downhole obstruction, the mandrel continues to move downhole and tubular sleeve is helically actuated to orient the eccentric end to the obstruction, the mandrel compressing the spring, and upon uphole movement of the mandrel the spring extends to aid to extend and reciprocate the outer tubular sleeve downhole and reset the helical drive. In an embodiment, at least the downhole end of the tool is manufactured of drillable materials.

Rotating Casing String

As discussed above, during cementing operations, there is also a need to manage wellbore fluids and cement. Placing a cement check valve below a tool introduces a vulnerability to cement incursion into the casing string. Until the advent of the embodiment above that integrates a drillable check valve into the drive's mandrel, check valves were installed above any tool.

Figure 6A:
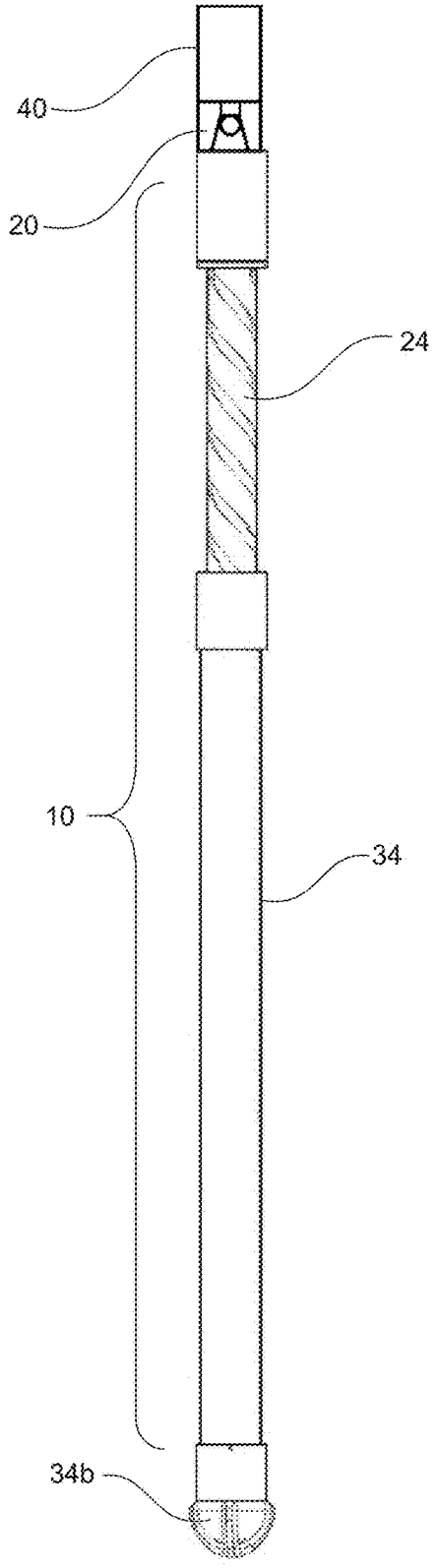
Fig. 6A Prior Art
FIG. 6A is a side view of a casing string with Applicant's prior art helical casing landing tool, axial reciprocation of the casing string actuating a rotating and oscillating motion of the bit for clearing obstructions, the landing tool as disclosed in Applicant's issued U.S. Pat. No. 8,973,682 issued on Mar. 10, 2015.

As illustrated in the prior art FIG. 6A, a downhole casing landing tool 10 has a drill bit 34*b* attached thereto. Due to the tool's mandrel 24 and sleeve 34 interface, the landing tool 10 is vulnerable to leakage from the annulus, between the wellbore and the tool, and the bore of the casing string. Accordingly, if cementing operations were to be contemplated, a check valve 20 was typically placed above the tool, typically between the casing string 40 and the tool 10, spaced a significant distance uphole of the bit 34*b*, isolating the vulnerable tool portion.

A relatively simple and inexpensive apparatus is provided herein which can be incorporated into the bottom or distal end of a casing string 40 that can be used to remove any wellbore obstructions, that enables cementing operations, and that can be left downhole after the casing string is landed and cementing operations are complete.

Figure 6B:
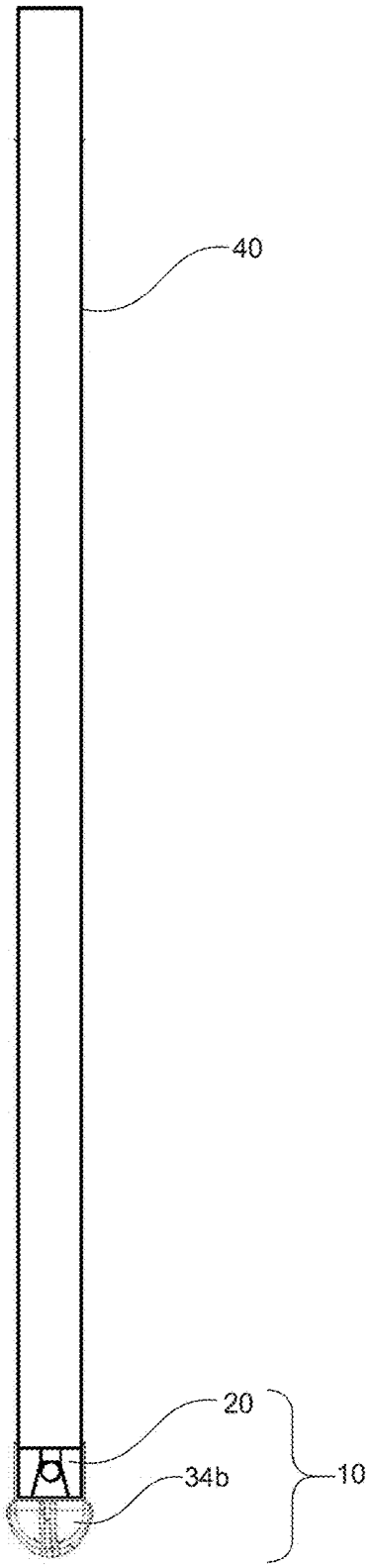
FIG. 6B is side view of an embodiment of an obstruction and cementing system illustrating a drill bit at a distal end of a casing string intended for rotation where possible and having an integrated check valve incorporated therein.

With reference to FIG. 6B, in another embodiment disclosed herein, a leading component, such as a bit 34*b*, is fit to the leading or distal end of a rotatable cementing string 40 for clearing obstructions and is fit with a check valve 20 to act as a float for cementing operations. The check valve-equipped bit 34*b* facilitates both obstruction clearing and cementing operations. Lacking any specific downhole apparatus for drilling, the arrangement is not vulnerable to cement intrusion into the cementing string above the bit from the annulus, but only through the bit's fluid ports. If additional wellbore depth is desired, the check valve 20 and bit 34*b* are also drillable. The cementing string 40 and bit 34*b* are cemented and left in place and the check valve and bit are substantially removed a subsequent drill string, such as the next stage of casing for cementing or a production string.

In greater detail, a casing string 14 having a casing bore, the casing string 40, capable of rotation, with an obstruction clearing leading component fit with a one-way check valve 20. This embodiment may be limited by wellbore conditions including, whether the wellbore is vertical, has a horizontal component and a manageable length of the wellbore. The check valve 20 avoids a need for a constant injection of flow of cement in order to avoid reverse flow of the cement slurry from the wellbore annulus back into the casing string 40. The leading component is a drill bit 34*b* adapted to house the check valve 20 integrated therein. The bit has bore in fluid communication with the casing bore.

Figure 7:
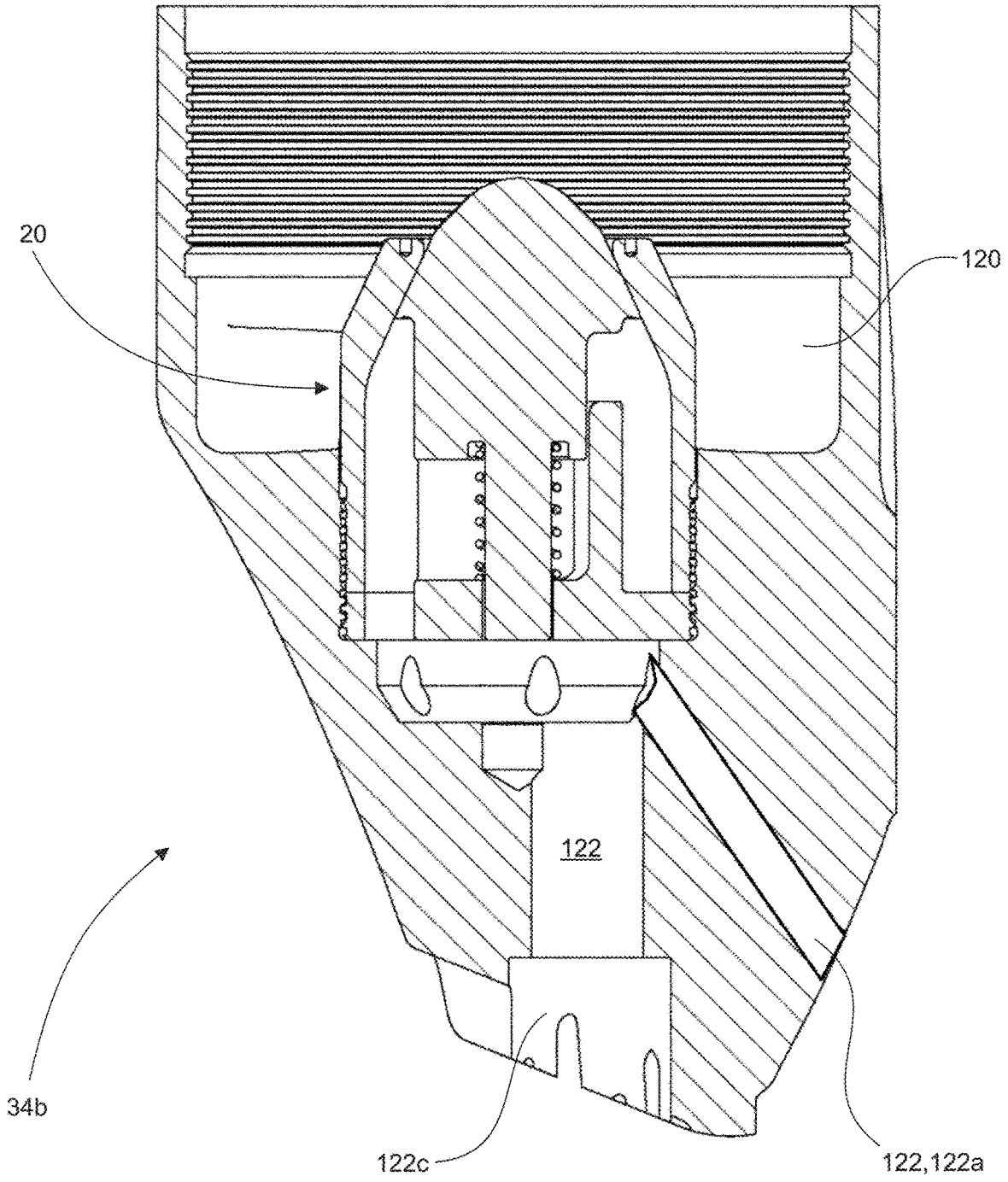
FIG. 7 is a cross-sectional view of an embodiment illustrating a drill bit having an integrated check valve assembly shown in its closed position.
Figure 10A:
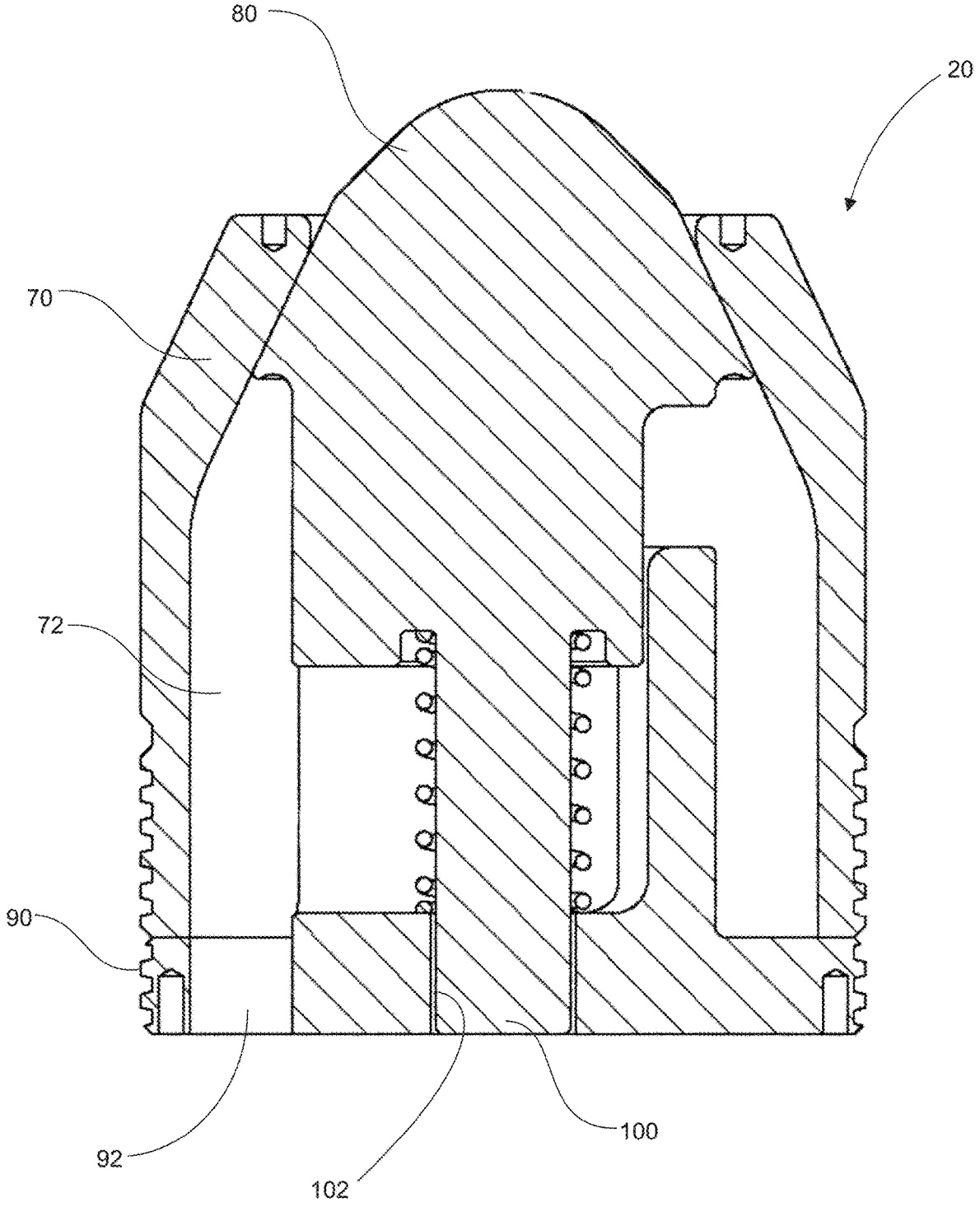
FIG. 10A is a side cross-sectional view of the integrated check valve assembly of FIG. 7 in its closed position.
Figure 10B:
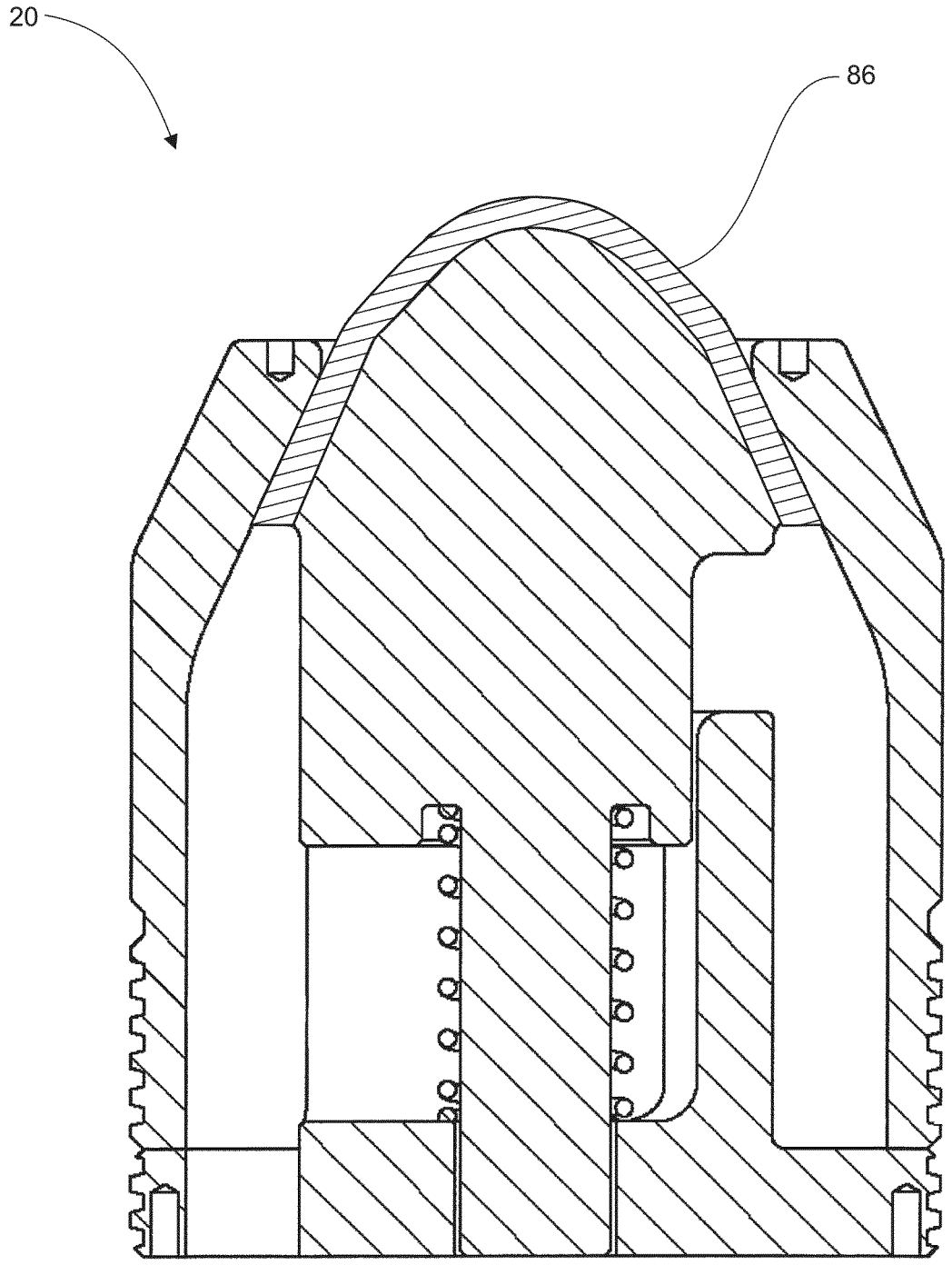
FIG. 10B is the integrated check valve of FIG. 10A having a polymer coating for the plunger of the check valve of FIG. 7.
Figure 11:
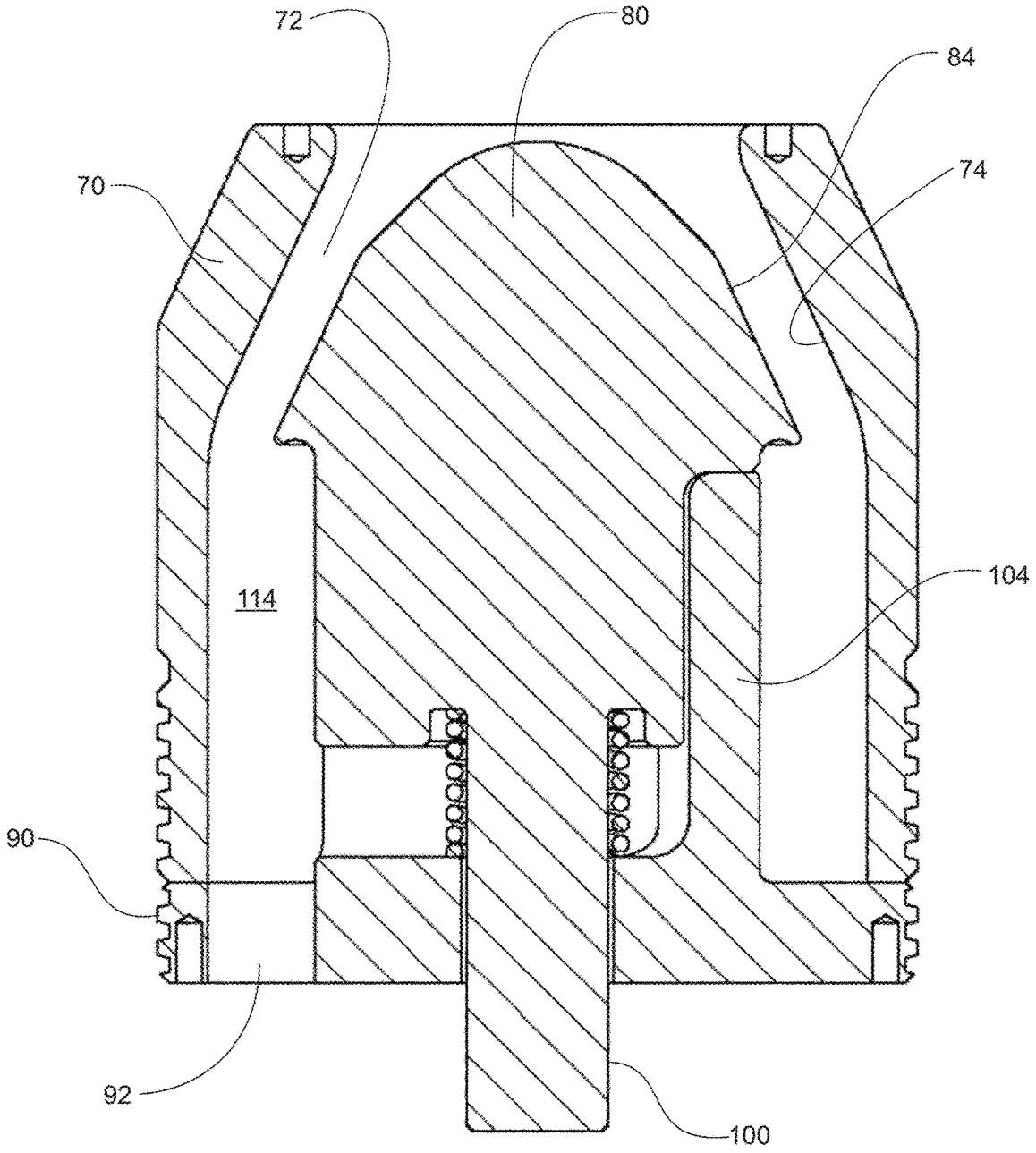
FIG. 11 is a side cross-sectional view of the integrated check valve assembly of FIG. 7 in its open position.

With reference to the tool of FIG. 7 and the detail of the check valve 20 in FIGS. 10A and 10B, and described in detail earlier for FIGS. 4A and 4B, the drill bit 34*b* has a bore 120 for conducting fluids F downhole and into the wellbore. The bore 120 is contiguous for fluid communication with the bore of the casing string 40. As shown, the check valve 20 is provided and adapted to be fit to or otherwise integrated with the drill bit 34*a*. The plunger can have a metal-to-metal seat face 84 to seal seat 74 as shown in FIG. 11, or a suitable elastomeric interface such as that shown in FIGS. 10B and 12.

Figure 8:
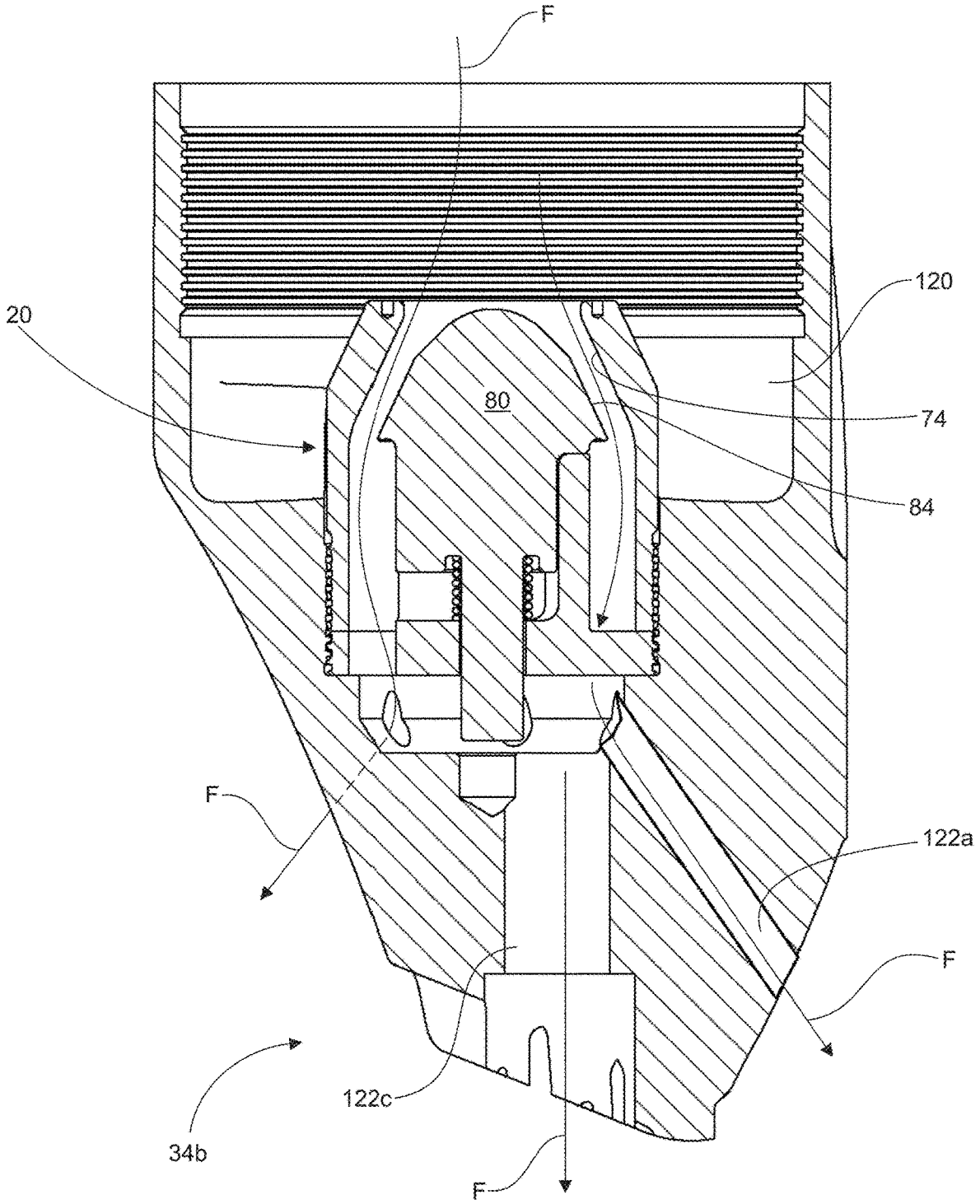
FIG. 8 is a cross-section view of the embodiment according to FIG. 7, illustrating the integral check valve assembly in its open position.

In FIG. 8 and illustrating the check valve in more detail in FIG. 10C, fluid flow F from the uphole casing string 40, be it obstruction-washing fluid or cement, flows into the bit bore 120, past the plunger 80, and through the check valve to one or more ports 122, including angled port or ports 122*a*, and a central port or ports 122*c*. The ports are the only vulnerable interface and they are downhole of the check valve 20.

As shown in FIG. 9, and similar to the check valve embodiment of FIG. 5, the shaft of the plunger 80 can be fit with corresponding axial guide slots 110 and radial ribs 112, formed in the boss 104 and on the plunger shaft 100 respectively. As the plunger 80 is actuated axially between the open and closed positions, the ribs 12 slide along the respective slots 110, preventing rotation of the plunger 80.

In other embodiments, the drill bit 34*b* with the integrated check valve 20 can have configurations suitable for overcoming various types obstructions including a sloped, augershaped or eccentric leading edge to aid in advancing past obstructions such as areas of sloughing along horizontal wellbores. Yet still, in another embodiment, the integrated check valve is rendered drillable, such as through the use of drillable materials and component design. In another aspect the check valve assembly is removably fit to the bit body The check valve can be fit to a variety of different bit style depending on the condition of the openhole wellbore.

Alternative Bits

Figure 13A:
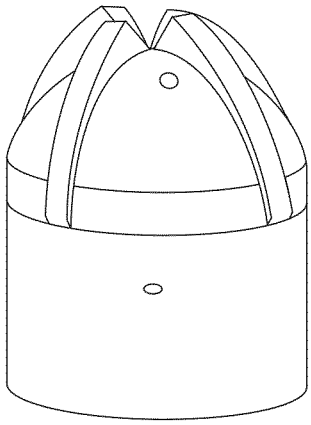
FIGS. 13A through 13C are side perspective views of various obstruction clearing bits that can be fit with a check valve assembly for cementing operations including a negotiating bit, a bridge breaking bit, and a casing pilot bit.

As shown in FIG. 13A, in one embodiment of a bit for negotiating or deflecting off of ledges, washouts and doglegs has a rounded bullnose profile. In one form, the negotiator bit features an all steel construction and is equipped with four axially-extending stabilizers tipped with tungsten carbide to facilitate reaming, cutting and agitation. In and other drillable form, the negotiator bit is manufactured of aluminum components.

Figure 13B:
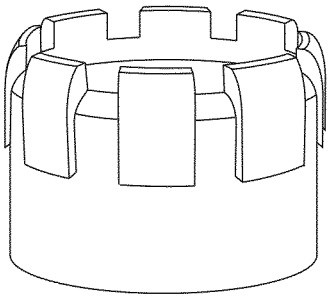

In another embodiment, as shown in FIG. 13B, an obstruction or bridge breaking bit is provided and well-suited to handle wellbore drilled through coal seams and swelling shales. In a generally castellated cutter profile, an outer row of cutters is designed to cut exposed shales and coal into large pieces, which are then further broken down by a row of radially inward cutters for easy removal by circulation. The breaker bit can comprise a body manufactured of an all bronze construction which makes it completely drillable, and is outfitted at its periphery with tungsten carbide buttons on radial engagement surfaces to resist wear, and tungsten carbide clusterites on forward cutting faces to increase the bits cutting and agitation power.

Figure 13C:
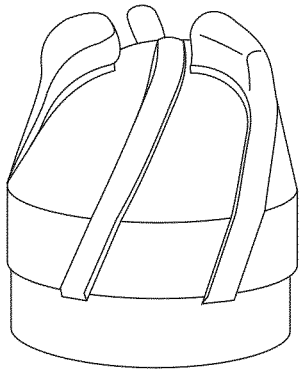

As shown in FIG. 13C, in another embodiment, a casing pilot bit is provided comprising a PDC equipped, yet drillable bit having a body made out of bronze, with tungsten carbide cutting faces and tungsten buttons on the radial outer diameter, helping to reduce wear due to friction. The casing pilot bit is a general all-around bit, suitable for reaming and bridge obstruction removal regardless of geology. The profile of the casing pilot bit maintains a long taper, allowing for some degree of deflection off of ledges, washouts, and doglegs.

Figure 14A:
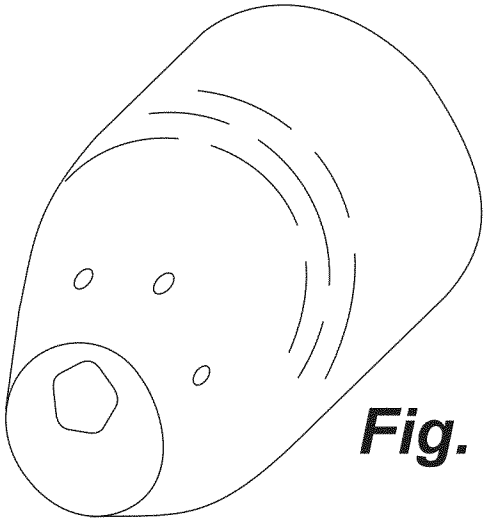
FIGS. 14A and 14B are perspective views and side views respectively of a slider eccentric bit.
Figure 14B:
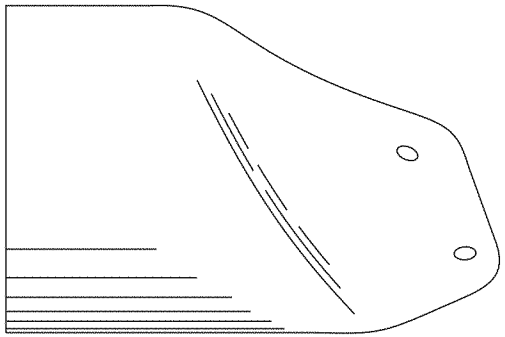

As shown in FIGS. 14A and 14B, in another embodiment, a cost effective bit is provided or less a bit and more a leading guide component. A slider bit having an eccentric or asymmetrical leading edge is as shown having an aggressive eccentric for wellbore obstructions involving extreme washouts, ledging and doglegs. Through rotation provided by Applicant's helical drive landing tool, the long eccentric nose of the bit rotates upon engagement with an obstruction to align towards the open portion of the wellbore, acting as a guide to deflect off of and away from the obstructions and to continue thereby. The slider eccentric bit features a smooth profile that enables sliding, but is not optimized for fill agitation, nor reaming. The body of the slider eccentric bit can be manufactured of aluminum composites for drillable removal using subsequent PDC bit-equipped secondary drill strings.

Figure 15A:
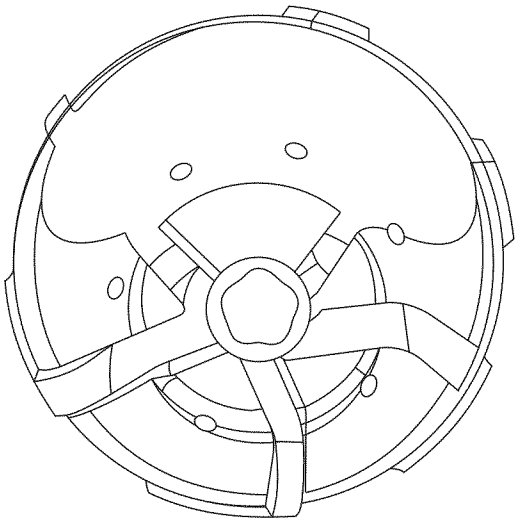
FIGS. 15A and 15B are end and side views respectively of a PDC eccentric bit.
Figure 15B:
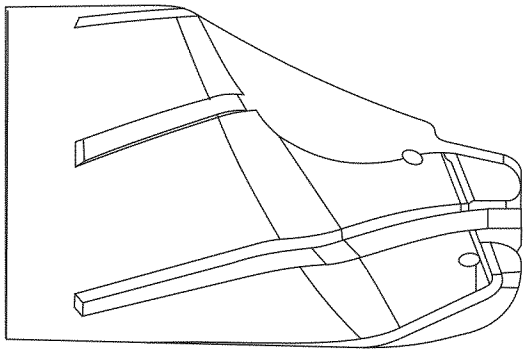

As shown in FIGS. 15A and 15B, in a more expensive embodiment of the slider bit, but more versatile, a polycrystalline diamond compact (PDC) eccentric bit comprises a heavy duty bronze body featuring a similar profile to the slider eccentric bit, however being equipped with a cutting face to assist with bridges and reaming as well. The long, eccentric profile seeks out the open side of the wellbore through rotation provided by the helical drive landing tools. Despite the eccentric shape, tool and bit rotation provides 360 degree reaming capability along its circumference with helical tungsten carbide cutting faces along the spade portion and about the uphole collar portion. Tungsten carbide buttons or tungsten carbide clusterites along the diameter resists wear. Hard facing formed along the diameter aid in minimizing body wear.

I claim:

1. A wellbore obstruction-clearing tool, fit to a downhole distal end of a casing string for advancing the casing string through obstructions in a wellbore, the casing string having an axial tubular bore therethrough, the tool comprising:

a tubular, rotatable sleeve for engaging the obstructions, the rotatable sleeve having an axial sleeve bore extending axially therethrough and a disruptor connected to a distal end thereof;

a tubular mandrel adapted for connection to the distal end of the casing string, the mandrel having an axial mandrel bore extending therethrough for fluid connection to the axial bore of the casing string, the mandrel fit concentrically within the sleeve bore for axial reciprocation of the sleeve between an upstroke and a downstroke;

a helical drive arrangement acting between the mandrel and the sleeve for driving the rotatable sleeve axially and rotationally along the mandrel during the downstroke and the upstroke of the mandrel between a retracted position and an extended position respectively;

a spring fit concentrically about an external surface of the mandrel and operative between the sleeve and the mandrel between the retracted and extended positions; and a check valve in the axial mandrel bore, wherein in the downstroke the sleeve is driven onto the mandrel to the retracted position; and in the upstroke, the spring biases the rotatable sleeve to the extended position.

2. The obstruction-clearing tool of claim 1 further comprising a check valve, the check valve comprising:

an uphole seat body having a bore and a seal seat;

a plunger having an uphole head and a seal face about the head for sealable engagement with the seal seat in a closed position and a downhole guide shaft for axially guiding the plunger, the shaft having one or more ribs extending axially and radially therefrom; and a downhole retainer body having a bore contiguous with the seal body's bore and an upstanding guide boss having a guide bore for slidably receiving the shaft, the boss having one or more axially extending slots open to the guide bore, each slot receiving a corresponding shaft rib for guiding the plunger axially between the closed position and an open position without relative rotation of the plunger.

3. The obstruction-clearing of claim 2 wherein the seal body, the retainer body and the plunger are drillable.

4. The obstruction-clearing of claim 2 wherein the check valve in the axial mandrel bore is located uphole of the helical drive.

5. The obstruction-clearing of claim 2 wherein the check valve is located at or above the rotating portion of the tool.

6. A method for landing casing in a wellbore and cementing an wellbore annulus thereabout comprising:

providing an obstruction clearing tool according to claim 1;

running in the casing string with the obstruction clearing tool at a downhole end thereof;

clearing obstructions in the wellbore with the tool;

landing the casing string at target depth; and delivering cement through the check valve for cementing the casing string therein.

7. The method of claim 6 further comprising:

rotating a downhole end of the tool to clear the obstructions; and delivering the cement through the check valve.

* * * * *